United States Patent [19]

Cannarsa

[11] 3,992,075

[45] Nov. 16, 1976

[54] CONTACT WASHER

[76] Inventor: Robert C. Cannarsa, 164 - 07 92nd St., Howard Beach, N.Y. 11414

[22] Filed: Apr. 10, 1975

[21] Appl. No.: 566,721

[52] U.S. Cl. ..... 339/232; 339/94 R; 339/278 C

[51] Int. Cl.[2] ..... H01R 11/26

[58] Field of Search ..... 85/1 JP, 50 R; 136/135; 339/94 R, 95 B, 116, 224, 231, 232, 263 B, 278 C

[56] References Cited

UNITED STATES PATENTS

| | | | |
|---|---|---|---|
| 1,356,404 | 10/1920 | Robinson | 85/50 R |
| 1,743,888 | 1/1930 | Hamister | 339/94 R |
| 3,389,368 | 6/1968 | Schaefer | 339/232 |
| 3,775,730 | 11/1973 | Rowls | 339/231 |

*Primary Examiner*—Roy Lake
*Assistant Examiner*—Mark S. Bicks
*Attorney, Agent, or Firm*—Richard L. Miller

[57] ABSTRACT

A novel type of washer for installation at a terminal of a storage battery so to make an improved electrical contact between the terminal; the washer consisting of a circular ring made of a tin and lead alloy which when squeezed between the face of the terminal and the face of a lug mounted on the end of the cable deforms the washer surface to fit precisely to the mating faces and forms a broad surface contact.

1 Claim, 5 Drawing Figures

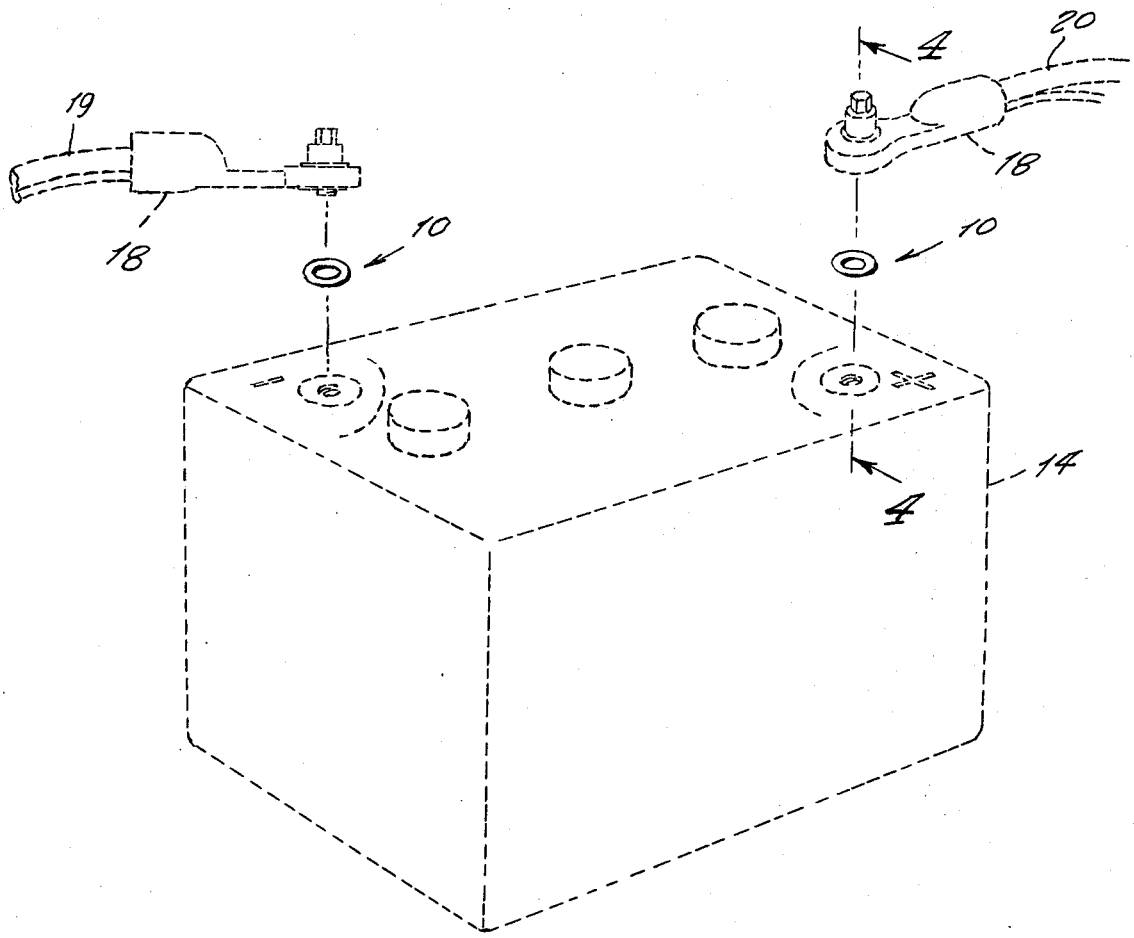
Fig. 1
Fig. 2
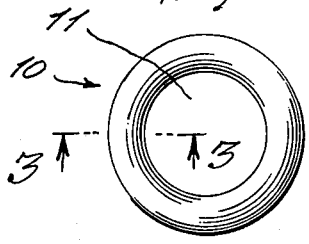
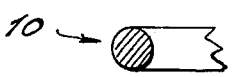
Fig. 3
Fig. 4
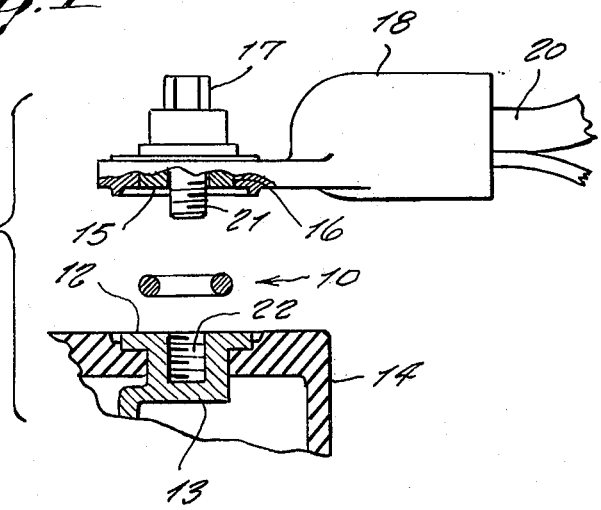
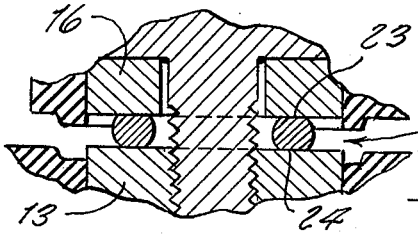
Fig. 5

CONTACT WASHER

This invention relates generally to storage batteries such as are installed within automotive vehicles, boats and the like.

It is well known that if a cable is not connected very tightly against a battery terminal that oxidation takes place therebetween resulting in corrosion built up that in time prevent an electric charge to pass between the terminal and cable. This is a common condition often seen particularly in automotive vehicles and is undesirable, so that the situation is in want of any improvement.

Accordingly, it is a principal object of the present invention to provide a means whereby the above described situation is prevented, and a good electrical contact is more permanently obtained between the battery terminal and cable.

Another object is to provide an intermediate member in the form of a readily deformable washer placable between the battery terminal and cable, and which precisely shapes itself minutely to the exact faces of the battery terminal and a lug on the end of the cable so that there is no space therebetween where oxidation and corrosion would otherwise occur.

Another object is to provide a contact washer which is quick to install.

Other objects are to provide a contact washer which is simple in design, inexpensive to manufacture, rugged in construction, easy to apply and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 1 is a perspective view of a storage battery and showing the present invention in position for being installed thereupon.

FIG. 2 is a top view of one of the contact washers shown per se.

FIG. 3 is a cross sectional view taken on line 3—3 of FIG. 2.

FIG. 4 is an enlarged cross sectional view taken on line 4—4 of FIG. 1, showing the shape of the contact washer prior to installation.

FIG. 5 is an enlarged detail view similar to FIG. 4 and showing the contact washer installed and its resultant change in shape.

Referring now to the drawing in detail, the reference numeral 10 represents a contact washer according to the present invention wherein the same consists of a single part, in the shape of a circular ring around a central circular opening 11. As shown in FIG. 3, the washer 10 is also circular in cross sectional configuration. The washer is made of an alloy consisting of tin and lead which are approximately in 50-50 per cent proportions. The size of the washer is such that it fits between a face 12 of an electrode 13 that forms a terminal in the late model design of a storage battery 14, and a face 15 of a special washer 16 installed around a screw 17 of a lug 18 formed on the end of either a ground or live battery cable 19 or 20 respectively, and the opening 11 is of a size so to receive a shank 21 of the screw.

In operative use, as shown in FIGS. 1 and 4, the contact washer is aligned to be fitted on the screw shank which is then screwed into the threaded opening 22 in the upper end of the terminal electrode. By turning the screw down hard, the contact washer is sufficiently squashed between the faces 12 and 15 so that it acquires flat faces 23 and 24 on opposite sides, their changing from making a circular line contact to making a circular broad surface contact. It is also to be noted that by thus being crushed between the faces 12 and 15, the faces 23 and 24 acquire any corresponding irregularities of the faces 12 and 15 so that the fit is absolutely perfect with no spaces therebetween so that no corrosion will result therebetween, and a strong electrical contact is permanently obtained therebetween.

Thus a useful contact washer is provided.

While certain novel features of this invention have been shown and described and are pointed out in the annexed claim, it will be understood that various omissions, substitutions and changes in the forms and details of the device illustrated and in its operation can be made by those skilled in the art without departing from the spirit of the invention.

I claim:

1. In a battery system including an electric storage battery having at least one terminal electrode with a flat upper surface and an internally threaded hole, a battery cable for connection to said terminal electrode, a lug terminating said battery cable, a special washer connected to said lug and having a flat lower surface and a screw coupled to said lug and extending through said washer for engaging said threaded hole, the improvement comprising, a ring-shaped contact washer with a circular cross section for insertion between the upper surface of said terminal and the lower surface of said special washer said contact washer being made of a metal alloy comprised of tin and lead, and capable of being deformed when pressed between said two flat surfaces to change its contact to said surfaces from a line contact to a broad surface contact.

* * * * *